US005109827A

United States Patent [19]

Nobe et al.

[11] Patent Number: 5,109,827

[45] Date of Patent: May 5, 1992

[54] IGNITION APPARATUS FOR AN INTERNAL COMBUSTION ENGINE

[75] Inventors: Hisanori Nobe; Mitsuru Koiwa, both of Himeji, Japan

[73] Assignee: Mitsubishi Denki Kabushiki Kaisha, Tokyo, Japan

[21] Appl. No.: 681,829

[22] Filed: Apr. 8, 1991

[30] Foreign Application Priority Data

Apr. 19, 1990 [JP] Japan ..... 2-101703

[51] Int. Cl.[5] ..... F02P 3/04

[52] U.S. Cl. ..... 123/618; 123/651

[58] Field of Search ..... 123/609, 618, 617, 644, 123/651

[56] References Cited

U.S. PATENT DOCUMENTS

| | | | |
|---|---|---|---|
| 4,271,812 | 6/1981 | Bodig et al. | 123/609 |
| 4,397,290 | 8/1983 | Tanaka et al. | 123/618 |
| 5,014,675 | 5/1991 | Koiwa | 123/609 |

*Primary Examiner*—Tony M. Argenbright
*Attorney, Agent, or Firm*—Sughrue, Mion, Zinn, Macpeak and Seas

[57] ABSTRACT

An ignition apparatus for an internal combustion engine is provided which is simple in the circuit arrangement and highly reliable in operation. An electromagnetic pickup coil generates an ignition signal having a magnitude proportional to the number of revolutions per minute of the engine in synchrony with the rotation thereof for controlling an ignition coil. A waveform shaper in the form of a comparator shapes the ignition signal from the pickup coil into a signal containing a pulse having a rising edge and a falling edge. An integrator integrates the ignition signal from the pickup coil to provide a rpm voltage representative of the number of revolutions per minute of the engine. A signal level controller controls the voltage level of the ignition signal based on the rpm voltage generated by the integrator. A current absorber absorbs from the ignition signal a current in accordance with the voltage of a power supply which powers the ignition coil. A switch turns off the current absorber when the shaped signal generated by the waveform shaper rises. A current-absorption suppressor suppresses a current to be absorbed by the current absorber in accordance with the rpm voltage generated by the integrator.

10 Claims, 5 Drawing Sheets

50 CURRENT ABSORBER
CONSTANT VOLTAGE CIRCUIT
78
R16
R13
R14
R12
R11
R10
R17
Vcc
VR
VIR
VB
VI
E1
ER
I1
I5
I6
I7
A
F
INTEGRATION CIRCUIT 10
60 CURRENT-ABSORPTION SUPPRESSOR
1
2
3
4
5
6
7
11
12
13
17
18
19
51
52
53
61
62
63
63a
63b
63c
64
65
66
82

IGNITION APPARATUS FOR AN INTERNAL COMBUSTION ENGINE

BACKGROUND OF THE INVENTION

The present invention relates to an ignition apparatus for an internal combustion engine which is able to fire cylinders of the engine without fail irrespective of variations in the number of revolutions per minute of the engine as well as in the voltage of a power supply to the ignition apparatus. More specifically, it relates to an ignition apparatus of the character as above described which is simple in construction and high in operational reliability.

As generally recogized, with internal combustion engines such as automotive gasoline engines in which a plurality of cylinders are operated through four cycles including an intake stroke, a compression stroke, a combustion stroke and an exhaust stroke, an air/fuel mixture in each cylinder is compressed by a piston and a spark is generated by a spark plug at an optimum ignition timing for proper combustion to generate output power. At the time of ignition, in order for the explosive force generated by the combustion of the mixture in each cylinder to act as a force for pushing down a corresponding piston in an efficient manner, it is critical to generate a spark of sufficient energy at a proper crank position of each cylinder.

Accordingly, with this type of internal combustion engine, for the purpose of properly controlling the order of fuel injections by injectors, the timing for power supply to the ignition coil and the ignition timing for each cylinder, it is necessary to generate an ignition signal is synchrony with the rotation of the engine and in dependence upon the number of revolutions per minute of the engine as well as other various driving conditions so that the conduction of the ignition coil and the firing timing for each cylinder are optimally controlled. In order to generate a proper ignition signal at proper timings, electromagnetic pickup coils are employed, for example, which generate an AC pulse signal in correspondence with the rotation of the engine crankshaft.

The ignition signals produced by the electromagnetic pickups are generated at timings corresponding to a certain predetermined crank angle of each cylinder and have a peak level corresponding to the number of revolutions per minute of the engine. The ignition signals thus produced are compared with a reference voltage in a comparison circuit and waveform shaped to provide a signal having a rectangular waveform which is then utilized to turn on and off a switching means such as, for example, a power transistor for controlling the power supply to the ignition coil.

Even with the use of an ignition signal thus waveform shaped, however, it is impossible to sharply raise or increase the primary current supplied to a primary winding of the ignition coil due mainly to an inductance component of the ignition coil. On the other hand, the discharge energy of the spark plug is determined by the primary current at the time when the power supply to the ignition coil is cut. As a result, a prescribed conduction time for the ignition coil is required for proper combustion of a mixture in each cylinder. That is, too early starting of power supply results in wasteful power consumption, whereas too late starting of power supply often results in misfiring. Accordingly, in order to ensure a proper conduction time, the timing for starting conduction should be appropriately changed in response to the number of revolutions per minute of the engine.

Further, in an early period of engine starting, the source voltage of a battery, which is usually 12 volts, generally drops to about 6 to 10 volts. As a result, in order to ensure a sufficient primary winding current for the ignition coil, it is necessary to lengthen the conduction time and for the purpose of compensating for a possible drop in the source voltage, the timing for starting power supply should be advanced.

In order to meet these requirements, it was proposed in the past that the voltage level of the ignition signal and the voltage level of the reference voltage employed for waveform shaping should be changed in dependence upon the number of revolutions per minute of the engine and the source voltage.

FIG. 5 illustrates a typical example of such a conventional ignition apparatus for an internal combustion engine as described in Japanese Patent Laid-Open No. 54-43433. The apparatus illustrated includes an electromagnetic pickup coil 1 for generating an ignition signal $V_I$ in the form of an AC pulse which has a pulse width corresponding to the number of revolutions per minute of the engine in synchrony with the rotation thereof. The elctromagnetic pickup coil 1 may be a coil having one end disposed in a spaced opposing relation with the crankshaft (not shown) which is provided on the outer periphel surface thereof with a plurality of magnetic elements which are disposed at circumferentially equal intervals.

A comparator 2 compares the ignition signal $V_I$ from the electromagnetic pickup coil 1 with a reference voltage $V_R$ to provide a waveform shaped signal $V_{IR}$ having a rectangular waveform. An amplifier 3 properly controls or amplifies the voltage level of the output signal $V_{IR}$ from the comparator 2 which is fed to a switching means 4. The switching means 4 comprises a pair of first and second power transistors 4*a*, 4*b* coupled with each other in a two-staged manner. The first transistor 4*a* has a base connected to the output terminal of the amplifier 3, a collector coupled to a collector of the second transistor 4*b* and an emitter coupled to a base of the second transistor 4*b* which has an emitter connected to ground through a resistor 4*c*. The collector of the second transistor 4*b* is connected to one end of a primary winding of an ignition coil 6. The other end of the primary winding is connected to a battery 5 having a source voltage of $V_B$ volts (e.g., 12 volts). The ignition coil 6 includes the primary winding and a secondary winding which has one end thereof connected with the other end of the primary winding. A spark plug 7 is connected between the other end of the secondary winding of the ignition coil 6 and ground for generating a spark of a magnitude proportional to the primary current $I_I$ flowing in the primary winding at the time when the primary current is cut off.

An integration curcuit 10 integrates the ignition signal $V_I$ from the pickup coil 1 and generates a voltage. A representative of the number of revolutions per minute of the engine. The integration circuit 10 includes a diode 11 having an anode thereof connected to one end of the electromagnetic pickup coil 1 and a cathode thereof coupled to one end of a capacitor 12 which is grounded at the other end thereof, and a resistor 13 coupled in parallel with the capacitor 12. An amplifier 14 properly controls or amplifies the level of the voltage representative of the engine rpm at a node between the diode 11 and the capacitor 12. A pair of serially connected voltage-dividing resistors 15, 16 are connected between the output terminal of the amplifier 12 and ground for appropriately dividing the output voltage of the amplifier 14. The output voltage of the amplifier 14 thus divided by the resistors 15, 16 (i.e., the voltage across the resistor 16), which is designated by reference character B, is provided at a node between the resistors 15, 16. A comparator 17 has a positive or non-inverted input terminal connected to a node between the grounded emitter of the two-staged transistor couple 4 and the resistor 4c so as to be imposed upon by a voltage $E_I$ across the resistor 4a developed by the primary winding current $I_I$ flowing through the primary winding of the ignition coil 6 and the two-staged transistor couple 4, and a negative or inverted input terminal connected to a power supply 18 so as to be supplied with a reference voltage $E_R$. The comparator 17 compares the primary winding voltage $E_I$ with the reference voltage $E_R$ and generates an output signal F is $E_I > E_R$. The comparator 17 has an output terminal connected through a resistor 19a to the base of a transistor 19 which has a collector connected to the anode of the diode 11 of the integration circuit 10, and an emitter connected to ground. The comparator 17, the power supply 18 and the transistor 19 constitute a control circuit for controlling the output voltage A of the integration circuit 10 representative of the engine rpm in such a manner that the voltage A is reduced when the voltage $E_I$ corresponding to the primary current $I_I$ reaches the reference voltage $E_R$.

A bias circuit 20 is connected to the other end of the electromagnetic pickup coil 1 for generating a bias voltage $V_{IB}$ corresponding to the divided rpm voltage B across the resistor 16. The bias ccircuit 20 acts as a level control means for properly changing the voltage level of the ignition signal $V_I$. The bias circuit 20 includes a transistor 21 having a grounded collector and being driven by the divided rpm voltage B, a first power supply 22 having a constant voltage interposed between the battery 5 and the emitter of the transistor 21, a transistor 23 having a collector and a base connected to the opposite ends of the first power supply 22, respectively, so as to be thereby driven, a resistor 24 connected between the emitter of the transistor 23 and the other end of the pickup coil 1, a second power supply 25 having a constant voltage connected to the battery 5, a group of diodes 26 interposed between the second power supply 25 and ground with their polarities directed normally, a transistor 27 having a collector and a base connected to the opposite ends of the second power supply 25, respectively, a resistor 28 interposed between the emitter of the transistor 27 and the pickup coil 1, and a resistor 29 interposed between the emitter of the transistor 27 and ground.

An on-level setting circuit 30 operates to set a reference voltage $V_R$ in the form of an on-level reference voltage with which the output voltage $V_I$ of the pickup coil 1 is compared by the comparator 2. The circuit 30 generates an on-level reference voltage which varies in dependence upon the source voltage $V_B$ of the battery 5. The circuit 30 includes a constant voltage supply 31 connected to the battery 5, a group of diodes 32 connected to the constant voltage supply 31 with their polarities directed normally, a transistor 33 having a collector and a base connected to the opposite ends of the constant voltage supply 31, respectively, so as to be thereby driven, a resistor 34 for dividing the source voltage $V_S$ of the battery 5 to provide a partial or divided voltage $V_{SS}$, a transistor 35 having a grounded collector, an emitter commonly connected to the cathodes of the grouped diodes 32 and a base connected to one end of the resistor 34 so as to be driven by the divided voltage $V_{SS}$, a group of three transistors 36 connected between the battery 5 and the resistor 34, a group of two transistors 37 in the form of a so-called current mirror circuit connected between the battery 5 and ground as well as between the group of the transistors 36 and ground, a group of two transistors 38 in the form of a so-called current mirror circuit connected between the battery 5 and ground as well as between the group of transistors 37 and ground, and a Zener diode 39 interposed between the battery 5 and ground. A resistor R1 is interposed between the Zener diode 39 and the battery 5. A resistor R2 is interposed between the resistor R1 and the group of transistors 38. A resistor R4 is interposed between the group of transistors 37 and ground. A resistor R5 is interposed between a junction between the resistors R1, R2 and a junction between the group of transistors 36 and the resistor 34.

The emitter of the transistor 33 is commonly connected to one end of a resistor 44 which is grounded at the other end thereof, and to the negative or inverted input terminal of the comparator 2 so that a current having a magnitude proportional to the base-emitter voltage across the transistor 33, which is determined by the group of diodes 32 and the transistor 35, flows through the transistor 33, developing a reference voltage $V_R$ across the resistor 44 which is fed to the negative input terminal of the comparator 2.

An off-level setting circuit 40 operates to set a reference voltage $V_R$ in the form of an off-level reference voltage, which is lower than the on-level reference voltage, so as to provide hysteresis. Thus, the circuit 40 outputs the off-level reference voltage as the reference voltage $V_R$ to the negative input terminal of the comparator 2. The circuit 40 comprises a constant current supply 41 connected to the battery 5, a group of serially connected diodes 42 connected between the constant current supply 41 and ground with their polarities directed normally, a transistor 43 having a collector and a base connected to the opposite ends of the constant current supply 41, respectively, so as to be thereby driven, a resistor 44 connected between the emitter of the transistor 43 and ground, a transistor 45 having a grounded emitter, a base connected to the output terminal of the comparator 2, and a collector connected to the base of the transistor 33, and a resistor 46 connected between the output terminal of the comparator 2 and the base of the transistor 45. The collector and the emitter of the transistor 43 are connected to the collector and the emitter, respectively, of the transistor 33 in the on-level setting circuit 30. The resistor 44 has one end thereof commonly connected to the emitters of the transistors 33, 43. Accordingly, a current, which is proportional to a base-emitter voltage of the transistor 43 determined by the group of diodes 42, flows through the transistor 43 so that a voltage across the resistor 44 is thereby developed and supplied to the negative input terminal of the comparator 2.

The transistor 45 is driven to turn on upon rising (i.e., a rising edge) of the ignition signal $V_{IR}$ from the electromagnetic pickup coil 1 so that the current from the constant current supply 31 is bypassed to turn off the transistor 33.

The operation of the above-described conventional ingition apparatus for an internal combustion engine will now be described in detail while referring to a waveform diagram illustrated in FIG. 6.

First, the electromagnetic pickup coil 1 generates, in synchrony with the rotation of the engine crankshaft, an ignition signal $V_I$ having a peak level corresponding to the number of revolutions of the crankshaft. The ignition signal $V_I$ is fed to the positive or non-inverted input terminal of the comparator 2 where it is compared with a reference voltage $V_R$ fed to the negative input terminal thereof and waveform shaped into a rectangular pulse signal $V_{IR}$ containing rectangular pulses each of which has a rising edge and a falling edge. The thus shaped ignition signal $V_{IR}$ is properly amplified by the amplifier 3 and fet to the base of the first transistor 4a of the two-staged transistor couple 4 to drive the second transistor 4b thereof into a conductive state. Thus, a primary current $I_I$ begins to flow through the primary winding of the ignition coil 6 which is then cut off upon falling (i.e., a falling edge) of the shaped ignition signal $V_{IR}$. As a result, the spark plug 7 connected to the secondary winding of the ignition coil 6 generates a spark, thus firing a cylinder at a predetermined proper timing.

In this connection, it is supposed that the bias voltage $V_{IB}$ produced by the biasing circuit 20, which is determined by the constant current supply 25, the group of diodes 26, the transistor 27 and the resistor 29, be set to be at a prescribed constant level sufficient to operate the comparator 2.

On the other hand, the integration circuit 10 integrates the ignition signal $V_I$ from the pickup coil 1 to perform frequency to voltage conversion to provide a rpm voltage representative of the number of revolutions per minute of the engine. Specifically, each time the pickup coil 1 generates an ignition signal $V_I$, the capacitor 12 is charged or discharged through the resistor 13. Therefore, as the number of revolutions per minute of the engine increases to increase the frequency of the ignition signal $V_I$, the rate of charging the capacitor 12 becomes greater than the rate of discharging, thus increasing the rpm voltage A.

As a consequence, the divided rpm voltage B output from the amplifier 14 becomes higher, increasing the base voltage of the transistor 21 in the bias circuit 20. Accordingly, a current begins to flow from the constant current supply 22 to the base of the transistor 23, generating a voltage across the resistor 24. As a result, the bias voltage $V_{IS}$ is changed such that it is set by the transistor 23 and the resistor 24 and increases with the increasing rotational speed of the engine. Namely, the greater the rotational speed of the engine, the higher becomes the voltage level of the ignition signal $V_I$ from the pickup coil 1, so that the rising of each pulse of the shaped ignition signal $V_{IR}$ becomes more rapid or sharper, advancing the timing of starting the current supply to the primary winding of the ignition coil 6.

Further, the emitter voltage of the transistor 27 in the bias circuit 20, though it is superposed on the bias voltage $V_{IB}$, remains constant within the normal operating voltage range of the transistor 27 since the base voltage thereof determined by the constant current supply 25 and the group of diodes 26 is held constant. Accordingly, the bias voltage $V_{IB}$, which is determined by the transistor 27 and the resistor 29, acts to raise the voltage level of the ignition signal $V_I$ by a prescribed level, thus operating the comparator 2 without fail.

On the other hand, the on-level setting circuit 30 outputs a low-level reference voltage $V_R$ when the source voltage $V_B$ of the battery 5 is low whereas it outputs a high reference voltage $V_R$ when the source voltage $V_B$ is high. As a result, it becomes possible to make a pulse of the shaped ignition signal $V_{IR}$ rise not only at an early or advanced timing to ensure a sufficient conduction time for the ignition coil 6 when the source voltage $V_5$ of the battery 5 is low, but also at a late or retarded timing to avoid wasteful power consumption when the source voltage $V_B$ is high. Specifically, the one-level reference voltage $V_R$ is determined by the following formula, $$V_R = V_{SS} + 3V_F - V_F$$

where $V_F$ is the voltage across each of the diodes 32, the voltage across the transistor 33, and the voltage across the transistor 35.

Here, assuming that the resistances of the resistors R1 through R5 and 34 are $R_1$ through $R_6$, respectively, and the divided voltage at the node between the resistors R1, R2 is $V_A$, a divided voltage $V_{SS}$ across the resistor 34 in the case of a low source voltage $V_B$ of the battery 5 is expressed as follows.

$$V_{SS} = V_A \times R_6/(R_5+R_6) + R_6[V_B - R_3 \cdot (V_A - V_F)/R_2 - V_F]/R_4$$

In this connection, assuming that the currents through the resistors R2, R3 are $i_2$, $i_3$, respectively, the following equation is established.

$$(V_A - V_F)/R_2 = i_2 = i_3$$

As a result, assuming that the currents through the collectors of the pair of opposed transistors of the grouped transistors 36, which have their bases coupled with each other, are $i_4$, $i_6$, respectively, the following equation is established.

$$[V_B - R_3 (V_A - V_F)/R_2 - V_F]/R_4 = i_4 = i_6$$

On the other hand, the divided voltage $V_{BB}$ across the resistor 34 in the case of a high source voltage $V_B$ of the battery 5, in which the Zener diode 39 is broken down, is expressed as follows;

$$V_{BB} = V_Z \times R_6/(R_5+R_6) + R_6[V_B - R_3(V_Z - V_F)/R_2 - V_F]/R_4$$

where $V_Z$ is the constant voltage across the Zener diode 39 when it is conductive. Accordingly, the current $i_4$ flowing through the grouped transistors 36 into the grouped transistors 37 is expressed as follows.

$$i_4 = [V_B - R_3(V_Z - V_F)/R_2 - V_F]/R_4$$

In this case, $[R_3(V_Z - V_F)/R_2 - V_F]$ is constant, so if the source voltage $V_S$ increases, the current $i_4$ and the current $i_6$ increases. As a result, the divided voltage $V_{SS}$ also increases to raise the base-emitter voltage of the transistor 35, increasing the base-emitter voltage of the transistor 33, so that current through the resistor 44 increases to raise the reference voltage $V_R$.

When the shaped ignition signal $V_{IR}$ rises with the reference voltage $V_R$ thus set, it is fed through the resistor 46 to the base of the transistor 45 and turns it on. A current from the constant current supply 31 flows to ground via the now conductive transistor 45, turning off the transistor 33. Thus, the reference voltage $V_R$ is set by the constant current supply 41 and the transistor 43 whose base voltage is determined by the group of diodes 42.

As a result, the reference voltage $V_R$ in the form of an off-level reference voltage across the resistor 44 thus developed decreases so that the reference voltage $V_R$ as a whole has hysteresis, as shown by the chained line in FIG. 6, thus suppressing adverse influences of noise on ignition timings.

With the conventional ignition apparatus for an internal combustion engine as described above, the level of the ignition signal $V_I$ or the level of the reference voltage $V_R$ used for shaping the waveform thereof is varied in accordance with variations in the number of revolutions per minute of the engine and the source voltage of the power source such as the battery 5. For this purpose, the bias circuit 20, the on-level setting circuit 30 and the off-level setting circuit 40 are provided, and the electromagnetic pickup coil 1 is connected at one end thereof to the bias circuit 20 and at the other end thereof to the comparator 2. This results in a rather complicated circuit arrangement, an increased number of manufacturing steps, and a reduction in reliability.

SUMMARY OF THE INVENTION

The present invention is intended to obviate the above-mentioned problems of the conventional ignition apparatus, and has for its object the provision of a novel and improved ignition apparatus for an internal combustion engine which is simple in the circuit arrangement, and improved in reliability.

To achieve the above object, according to the present invention, there is provided an ignition apparatus for an internal combustion engine comprising:

a signal generator for generating an ignition signal having a magnitude proportional to the number of revolutions per minute of the engine in synchrony with the rotation thereof;

an ignition coil having a primary winding and a secondary winding;

a spark plug connected to the secondary winding of the ignition coil for firing a cylinder;

a waveform shaper for shaping the ignition signal from the signal generator into a signal containing a pulse having a rising edge and a falling edge;

a power supply connected to the ignition coil;

a first switch connected between the power supply and the ignition coil for switching on and off the conduction between the power supply and the primary winding of the ignition coil based on the ignition signal shaped by the waveform shaper;

an integrator for integrating the ignition signal from the signal generator to provide a rpm voltage representative of the number of revolutions per minute of the engine;

a signal level controller for controlling the voltage level of the ignition signal based on the rpm voltage generated by the integrator;

a resistor interposed between the signal generator and the waveform shaper;

a current absorber for absorbing from the ignition signal a current in accordance with the voltage of the power supply;

a second switch operable to turn off the current absorber when the shaped signal generated by the waveform shaper rises; and a current-absorption suppressor for suppressing a current to be absorbed by the current absorber in accordance with the rpm voltage generated by the integrator.

Preferably, the signal generator comprises an electromagnetic pickup coil which has one end thereof connected to ground and the other end thereof connected to the waveform shaper through a resistor.

In one embodiment, a buffer is connected between the signal generator and the current absorber for eliminating a change in the level of the ignition signal due to variations in the internal impedance of the electromagnetic pickup coil.

Preferably, the buffer comprises a buffer transistor which has an emitter connected to the power supply, a base connected to the waveform shaper and the current absorber, and a collector connected to ground. A constant current supply may be interposed between the emitter of the transistor and the power supply for supplying a constant current to the emitter of the buffer transistor irrespective of variations in the voltage of the power supply.

In a preferred form, the waveform shaper comprises a comparator which has a first input terminal connected to the signal generator and the current absorber, and a second input terminal connected to the signal level controller, the comparator making a comparison between the ignition signal from the signal generator and the output signal of the signal level controller and generating an output signal to the first switch when the voltage level of the ignition signal is greater than that of the output signal of the signal level controller.

Preferably, the signal level controller comprises:

an on-level setting circuit for setting an on-level voltage for the comparator; and an off-level setting circuit for setting an off-level voltage for the comparator, the off-level setting circuit being operable to reduce the output of the on-level setting circuit by a prescribed extent when the comparator generates an output.

The above and other objects, features and advantages of the present invention will become more readily apparent from the following detailed description of a few preferred embodiments of the invention taken in conjunction with the accompanying drawings.

DESCRIPTION OF THE PREFERRED EMBODIMENTS

A few preferred embodiments of the present invention will now be described in detail with reference to the accompanying drawings.

Figure 1:
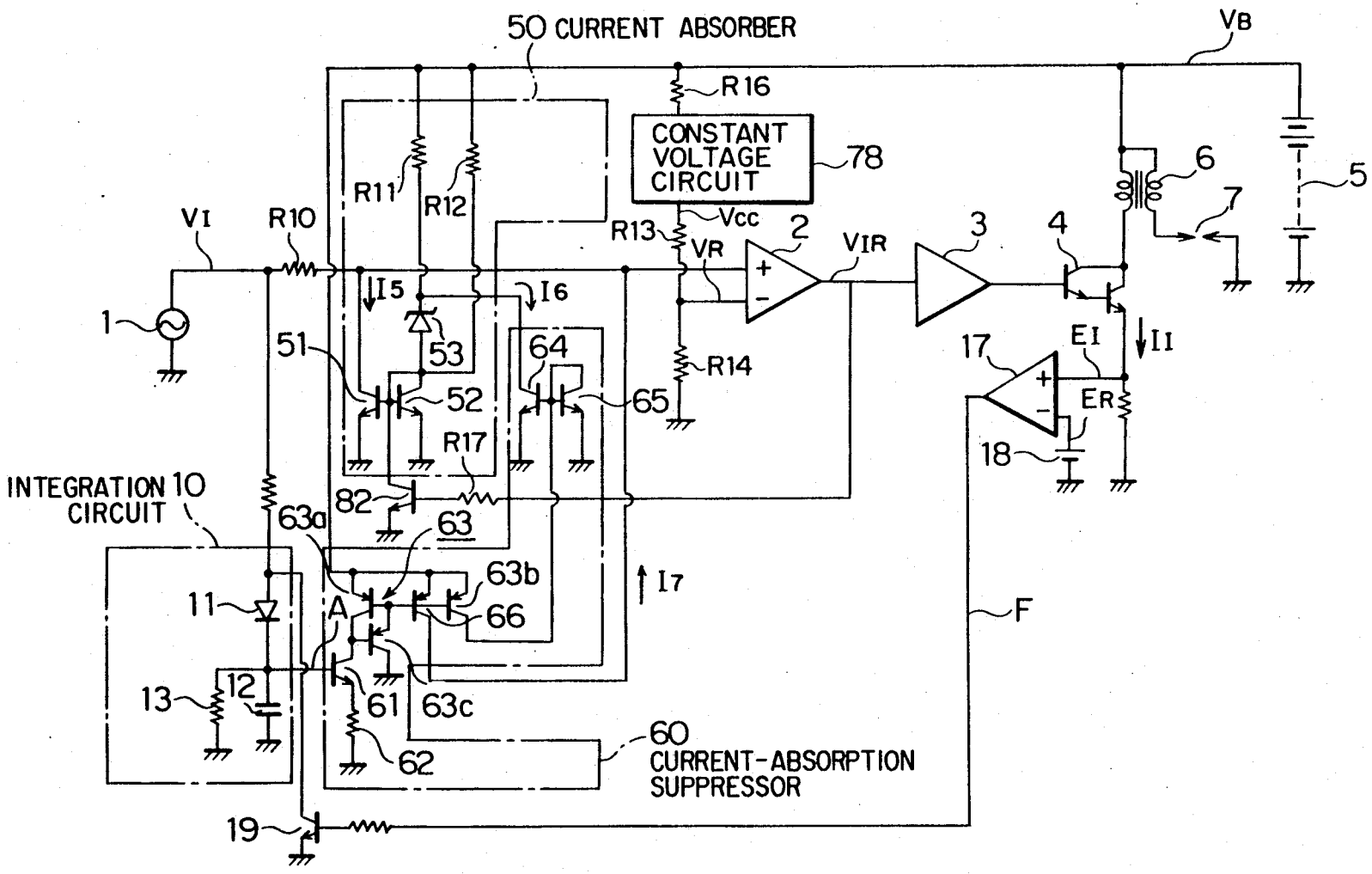
FIG. 1 is a circuit diagram of an ignition apparatus for an internal combustion engine in accordance with one embodiment of the present invention.

FIG. 1 shows an ignition apparatus for an internal combustion engine in accordance with a first embodiment of the invention. In this figure, elements 1 through 7, 10 through 13 and 17 through 19 are the same as employed in the above-described conventional ignition apparatus of FIG. 5. The ignition apparatus of this embodiment includes, in addition to the above-mentioned same components, additional elements which will be described below.

In this embodiment, one end of a signal generator 1 in the form of an electromagnetic pickup coil is grounded. A current absorber 50 absorbs current $I_5$ from an ignition signal $V_I$ of the pickup coil 1 via a resistor R10 in dependence upon the source voltage $V_S$ of a power source 5 in the form of a battery. The current absorber 50 includes an NPN transistor 51 having a grounded emitter and a collector connected to a comparator 2, and an NPN transistor 52 having a grounded emitter, a base connected to the base of the transistor 51 and a collector commonly connected to the bases of the transistors 51, 52 and to the battery 5 through a Zener diode 53 and a resistor R11. A resistor R12 is connected between the collector of the transistor 52 and the battery 5 in parallel with the Zener diode 53 and the resistor R11.

A current-absorption suppressor 60 suppresses the current $I_5$ absorbed by the current absorber 50 in dependence upon a rpm voltage A which is output by an integration circuit 10. The current-absorption suppressor 60 includes an NPN transistor 61 having a grounded emitter and a base connected to the cathode of a diode 11 in the integration circuit 10. A resistor 62 is connected between the emitter of the transistor 61 and ground. A group of transistors 63 includes a first PNP transistor 63*a* having an emitter connected to the battery 5 and a collector coupled to the collector of the transistor 61, a second PNP transistor 63*b* having a base and an emitter coupled to the base and emitter, respectively, of the first transistor 63*a*, and a third PNP transistor 63*c* having a base connected to a node between the collectors of the transistors 61, 63*a*, an emitter commonly coupled to the bases of the first and second transistors 63*a*, 63*b* and a collector grounded. An NPN transistor 64, which is driven by the group of transistors 63, has an emitter grounded and a collector connected to a node between the Zener diode 53 and the resistor R11 so as to bypass the suppression current $I_6$. An NPN transistor 65 has an emitter grounded, a base coupled to the base of the transistor 64 and to the collector of the second tansistor 63*b*, and a collector commonly coupled to the bases of the transistors 64, 65. A PNP transistor 66 is connected between the group of transistors 63 and a positive or non-inverted input terminal of the comparator 2 for suppressing the current $I_5$ to be absorbed by the current absorber 50. The transistor 66 has a base commonly coupled to the bases of the first and second transistors 63*a*, 63*b*, an emitter connected to the battery 5, and a collector connected to a node between the positive input terminal of the comparator 2 and the resistor R10 so as to supply current $I_7$ to the ignition signal $V_I$. The current-absorption suppressor 60 acts to adjust the voltage level of the ignition signal $V_I$ in accordance with the number of revolutions per minute of the engine.

A constant voltage circuit 78 is connected through a resistor R16 to the battery 5 for generating a prescribed constant voltage $V_{CC}$ based on the source voltage $V_S$ of the battery 5. The constant voltage circuit 78 has an output terminal connected to a negative or inverted input terminal of the comparator 2 through a voltage divider which includes a resistor R13 and a resistor R14 series connected with each other between the output terminal of the constant voltage circuit 78 and ground. A node between the resistors R13, R14 is connected to the negative input terminal of the comparator 2. The voltage divider acts as an on-level setting means for setting, based on the prescribed voltage $V_{CC}$, a reference voltage $V_R$ in the form of an on-level reference voltage for comparison with the ignition signal $V_I$.

A NPN transistor 82, which serves as a switching means for turning on and off the current absorber 50 based on the shaped ignition signal $V_{IR}$, has a base connected to the output terminal of the comparator 2 through a resistor R17, a collector commonly connected to the bases of the transistors 51, 52 and an emitter connected to ground. The NPN transistor 82 also serves as an off-level setting circuit for providing the reference voltage $V_R$ in the form of an off-level reference voltage with sufficient hysteresis.

Figure 2:
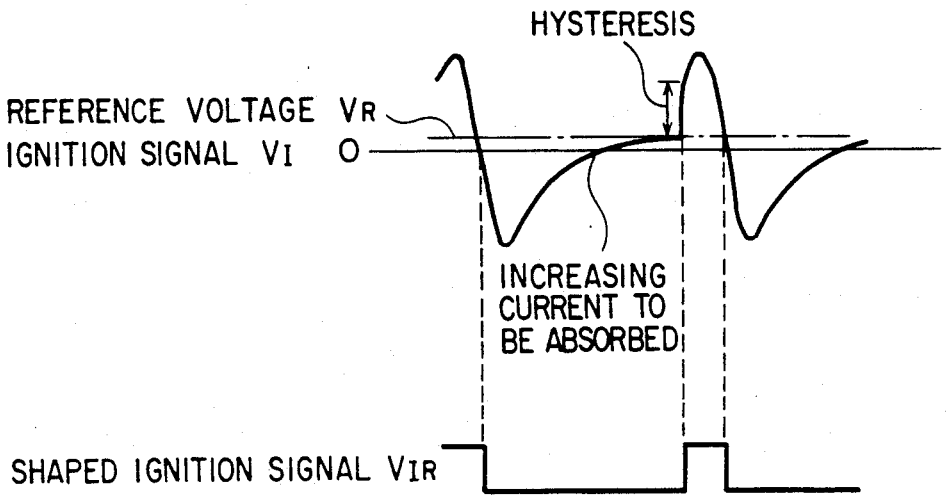
FIG. 2 is a waveform diagram showing the waveforms of an ignition signal $V_I$ and a shaped ignition signal $V_{IR}$ in a certain operating condition of the apparatus of FIG. 1.
Figure 3:
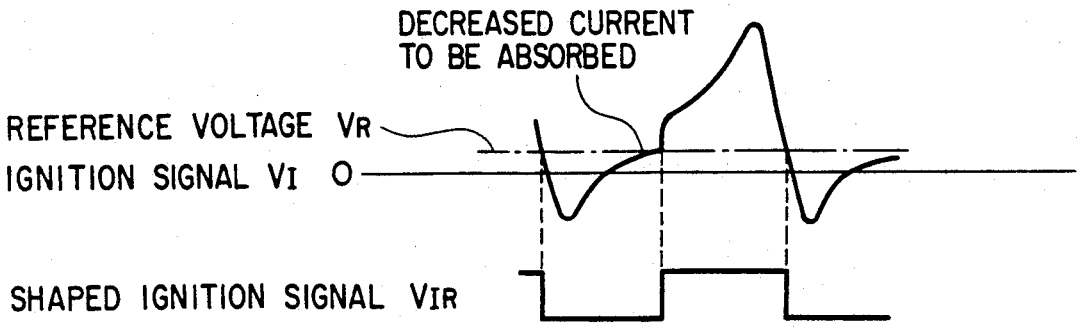
FIG. 3 is a view similar to FIG. 2, but in a different operating condition of the apparatus of FIG. 1.

The operation of the above embodiment of FIG. 1 will now be described in detail while referring to the waveform diagrams shown in FIGS. 2 and 3.

In this embodiment, the electromagnetic pickup coil 1 is connected at one end thereof to ground and at the other end to the current absorber 50 and the integration circuit 10 so that it generates an ignition signal $V_I$ which is supplied to the current absorber 50 and the integration circuit 10.

The ignition signal $V_I$ supplied to the current absorber 50 has its voltage level varied due to a current $I_5$ which is absorbed into ground through the transistor 51 in dependence upon the source voltage $V_B$ of the battery 5. That is, when the source voltage $V_B$ is low, the Zener diode 53 is interrupted or held non-conductive so that the current $i_5$ to be absorbed into ground through the collector-emitter path of the transistor 51 is determined by the base-emitter voltage thereof which is, in turn, determined only by a current flowing through the resistor R12. On the other hand, when the source voltage $V_B$ is high, the Zener diode 53 is broken down into a conductive state so that the base-emitter voltage of the transistor 51 determined by a current flowing through the resistors R11, R12 increases, resulting in an increase in the current $I_5$ to be absorbed.

Accordingly, when the source voltage $V_B$ is low, the current $I_5$ to be absorbed becomes limited, thus raising the level of the ignition signal $V_I$, whereas when the source voltage $V_B$ is high, current $I_5$ to be absorbed becomes significant, reducing the level of the ignition signal $V_I$. As a result, the timing of rising of the shaped ignition signal $V_{IR}$ is retarded as the source voltage $V_B$ increases, as clearly seen from FIG. 2, shortening the conduction time of the primary winding of the ignition coil 6.

Figure 5:
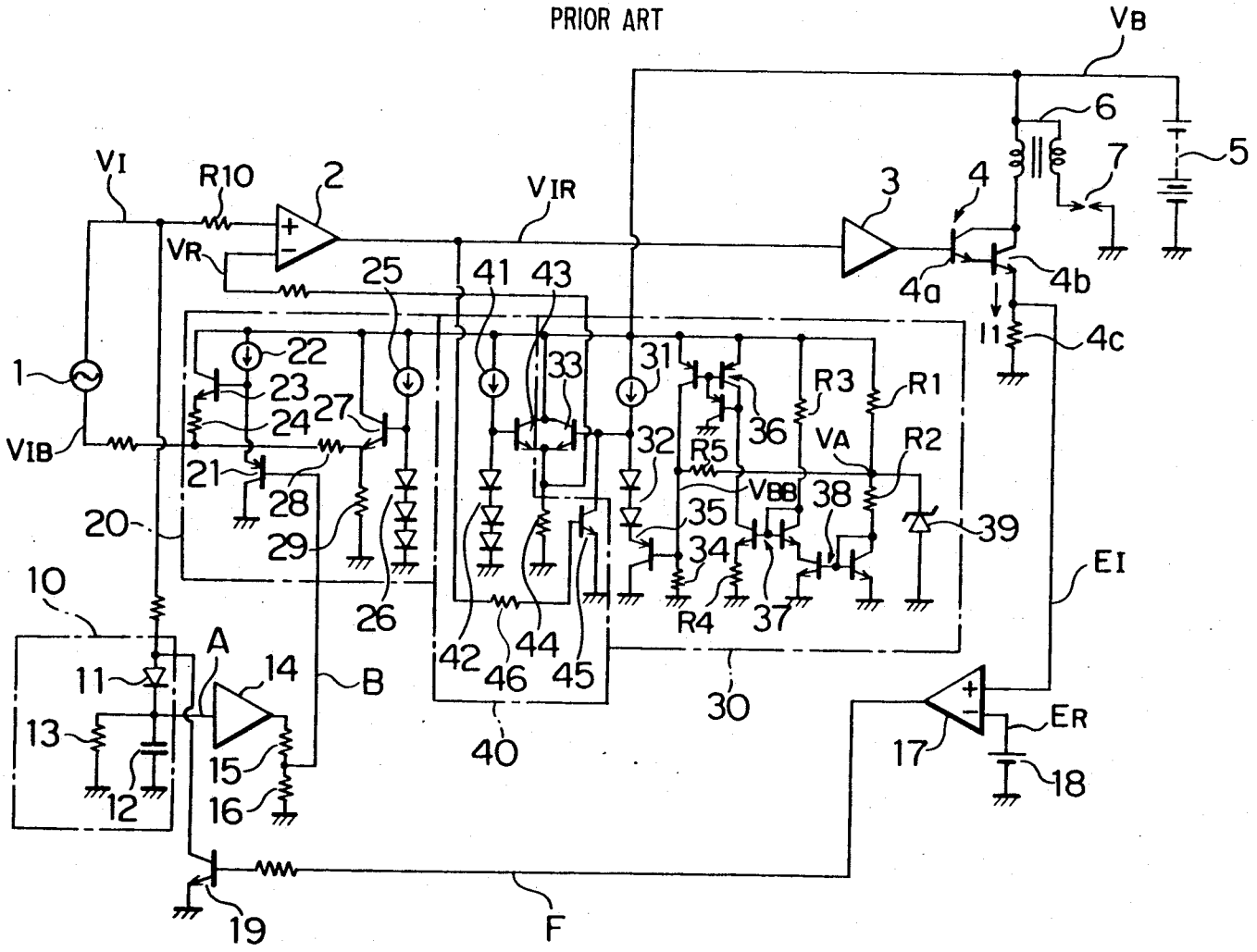
FIG. 5 PRIOR ART
FIG. 5 is a circuit diagram of a conventional ignition apparatus for an internal combustion engine.
Figure 6:
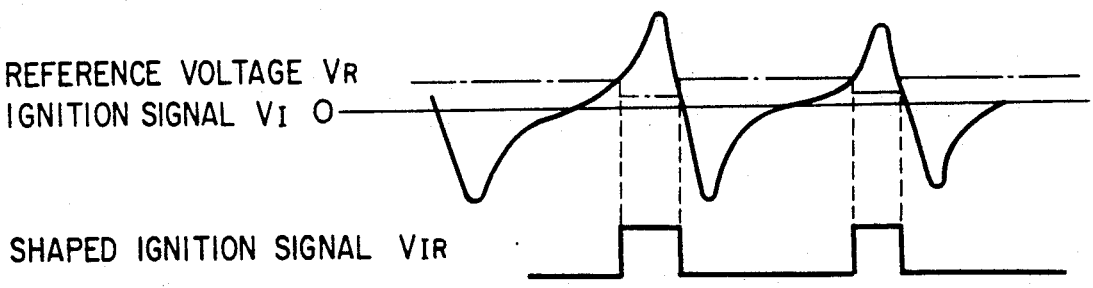
FIG. 6 PRIOR ART
FIG. 6 is a waveform diagram of an ignition signal $V_I$ and a reference signal as used in the conventional apparatus of FIG. 5.

On the other hand, the integration circuit 10 integrates the ignition signal $V_I$ from the pickup coil 1, as described before with reference to the conventional ignition apparatus of FIG. 5, and generates an output to the current-absorption suppressor 60 where as the rpm voltage A increases, the transistor 61 is made conductive to such an extent which depends upon the number of revolutions per minute of the engine. With the conduction of the transistor 60, the transistor 64 is also turned on through the two-staged transistor couple 63 so that current flowing from the battery 5 through the Zener diode 53 is bypassed as a suppression current $I_6$, reducing the base-emitter current of the transistor 51, which deternmines the current $I_5$ to be absorbed. Simultaneous with the turning on of the transistor couple 63, the transistor 66 is also turned into a conductive state so that a current $I_7$ is supplied to the ignition signal $V_I$. As a result, the current $I_5$ to be absorbed decreases and hence the level of the ignition signal $V_I$ to be fed to the positive input terminal of the comparator 2 increases. That is, the greater the number of revolutions per minute of the engine, the greater becomes the level of the ignition signal $V_I$, advancing the rising timing of the shaped ignition signal $V_{IR}$, as shown in FIG. 3. Thus, the conduction time of the primary winding of the ignition coil 6 can be increased to a sufficient extent.

In this manner, the rising timing of the shaped ignition signal $V_{IR}$ is properly controlled in accordance with the rpm voltage and the source voltage $V_B$ of the battery 6 by changing the level of the ignition signal $V_I$ by means of the first and second current supplies 50, 60.

In addition, the on-level of the reference voltage $V_R$, which is determined by the voltage-dividing resistors R13, R14, is expressed as follows:

$$V_R = V_{cc} \times R_{14}/(R_{13}+R_{14})$$

where $R_{13}$ and $R_{14}$ are the electric resistances of the voltage-dividing resistors R13, R14, respectively. Therefore, taking account of the current $I_5$ to be absorbed by the current absorber 50, the practical on-level $V_{ON}$ of the ignition signal $V_I$, which is generated by the electromagnetic pickup coil 1 during the low rotational speed of the engine, is expressed as follows;

$$V_{ON} = V_{cc} \times R_{14}/(R_{12}+R_{14}) + R_{10}[(V_B - V_F)/R_{12} + (V_B - V_Z - V_F)/R_{11}]$$

where $V_Z$ is the voltage across the Zener diode 53 and $V_F$ is the voltage across the transistor 51. The term $R_{10}(V_B - V_Z - V_F)/R_{11}$ in the above formula is calculated only if $V_5 > V_Z + V_F$.

On the other hand, during the high rotational speed of the engine, the rpm voltage A is first determined by the integration circuit 10 which integrates the ignition signal $V_I$ and a suppression circuit which includes elements 17 through 19 for detecting the primary winding current $I_I$ which flows through the primary winding of the ignition coil 6, and for suppressing the rpm voltage A based on the primary winding current $I_I$ thus detected. The current $I_5$ to be absorbed is then controlled on the basis of the rpm voltage A thus determined. Finally, the on-level $V_{ON}$ during the high rotational speed of the engine is determined on the basis of the product of the absorbed current $I_5$ and the resistance $R_{10}$ of the resistor R10, and the above calculated $V_{ON}$ during the low rotational speed of the engine. For example, the on-level $V_{ON}$ during the high rotational speed of the engine is calculated as follows;

$$V_{ON} = V_{cc} \times R_{14}/(R_{12}+R_{14}) + R_{10}[(V_B - V_F)/R_{12} + (V_B - V_Z - V_F)/R_{11} - I_6]$$

where $I_6$ is the current flowing through the transistor 64, which varies depending upon the rpm voltage A.

The off-level of the reference voltage $V_R$ is set by turning off the current absorber 50. That is, the transistor 82 is turned on upon the rising edge of a rectangular pulse of the shaped ignition signal $V_{IR}$ so that the current supplied to the transistors 51, 52 from the battery 5 by way of the resistor R11 and the Zener diode 53 and by way of the resistor R12 is bypassed to ground through the now conductive transistor 82, thus turning off the transistor 51 and hence the current absorber 50.

After the rising of the shaped ignition signal $V_{IR}$ (i.e., after the turning off of the transistor 82), the current $I_5$ to be absorbed by the current absorber 50 is stopped, raising the level of the ignition signal $V_I$ to be supplied from the pickup coil 1 to the positive input terminal of the comparator 2. As a result, sufficient hysteresis is provided to the reference voltage $V_R$ (see FIG. 2).

However, with the above-described embodiment, the current absorber 50 for absorbing a part of current $I_5$ from the ignition signal $V_I$ is directly connected via the resistor R10 to the other end of the electromagnetic pickup coil 1 so that the ignition signal $V_I$ during current absorption is influenced by variations (i.e., particularly reduction) in the internal impedance of the current absorber 50. That is, the setting of the on-level $V_{ON}$, which is made on the basis of the resistance $R_{10}$ of the resistor 10 and the internal impedance of the pickup coil 1, is liable to be subject to variations.

Figure 4:
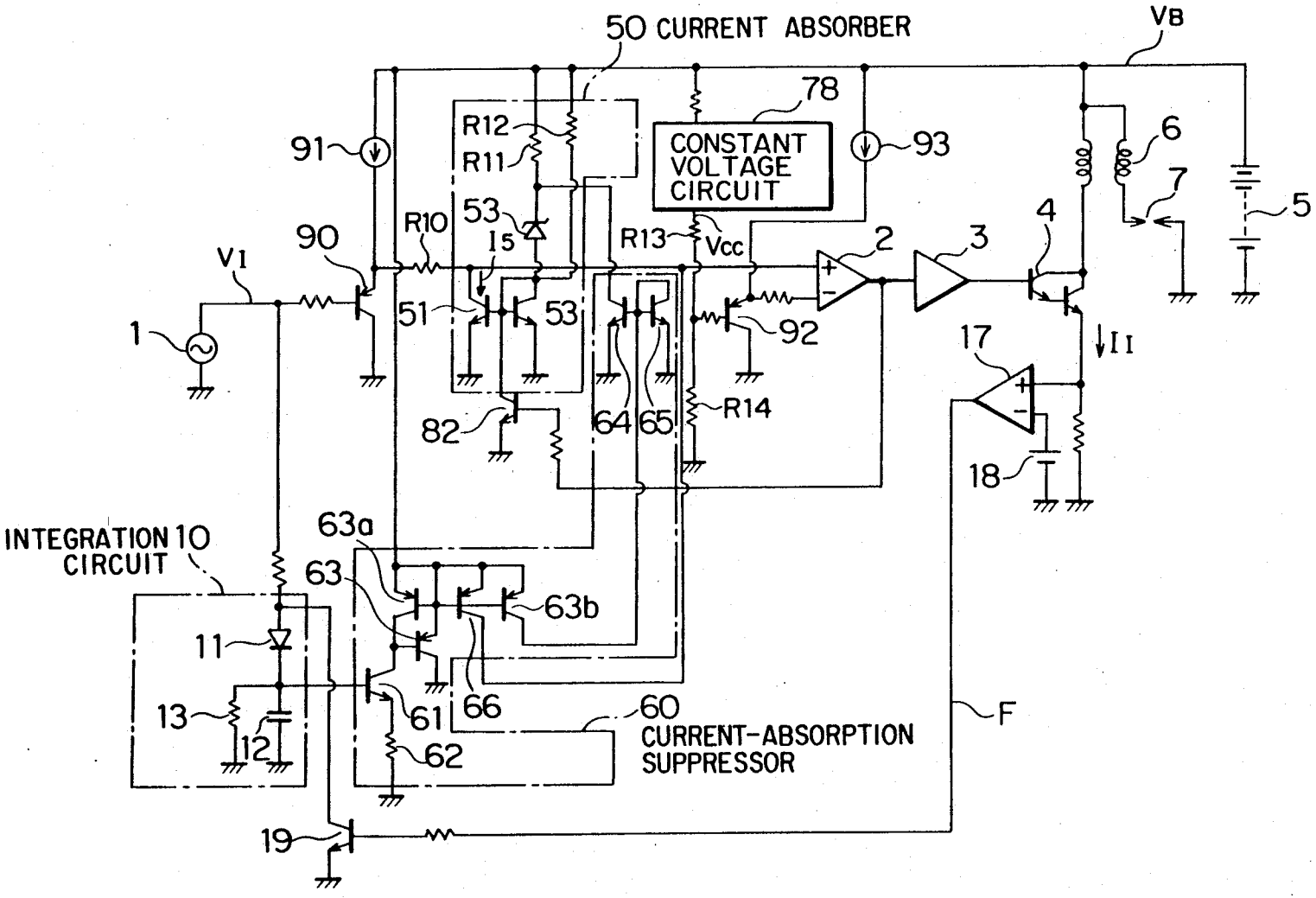
FIG. 4 is a circuit diagram of another embodiment of the invention.

In order to avoid this problem, the current absorber 50 may be connected to the pickup coil 1 through a buffer, as shown in FIG. 4.

FIG. 4 shows another embodiment of the invention which is able to eliminate the influences of variations in the internal impedance of the pickup coil 1 on the setting of the on-level $V_{ON}$. In this figure, a buffer 90 is interposed between the electromagnetic pickup coil 1 and the current absorber 50. In the illustrated example, the buffer 90 comprises a PNP transistor which has a collector connected to ground, a base connected to the output terminal of the pickup coil 1, and an emitter connected to the resistor 10. A constant current supply 91 is connected between the emitter of the transistor 90 and the battery 5 for supplying current to the transistor 90 in accordance with the source voltage $V_B$ of the battery 5.

A PNP transistor 92 is connected to the negative input terminal of the comparator 2. The transistor 92 has a grounded collector, a base connected to a node between a pair of voltage-dividing resistors R13, R14, and an emitter connected to the negative input terminal of the comparator 2. A constant current supply 93 is connected between the emitter of the transistor 92 and the battery 5 for balancing with the constant current supply 91 for the buffer 90.

The transistors 90, 92 and the constant current supply 91, 93 are substantially of the same arrangement as an unillustrated multi-staged circuit inside the comparator 2 and hence they may be considered to form a part of the comparator 2.

With this FIG. 4 embodiment, an ignition signal $V_I$ from the electromagnetic pickup coil 1 is input to the buffer transistor 90 so that the level of the ignition signal $V_I$ is controlled by those elements which are connected to the transistor 90. In this case, since current $I_5$ is absorbed from the ignition signal $V_I$ through the transistor 90, the influences of variatons in the internal impedance of the electromagnetic pickup coil 1 is substantially removed. In addition, the entire circuit for setting the on-level $V_{ON}$ can be incorporated in a monolithic IC so as to reduce variations in the setting of the on-level $V_{ON}$.

What is claimed is:

1. An ignition apparatus for an internal combustion engine comprising:

a signal generator for generating an ignition signal having a magnitude proportional to the number of revolutions per minute of the engine in synchrony with the rotation thereof;

an ignition coil having a primary winding and a secondary winding;

a spark plug connected to the secondary winding of said ignition coil for firing a cylinder;

a waveform shaper for shaping the ignition signal from said signal generator into a signal containing a pulse having a rising edge and a falling edge;

a power supply connected to said ignition coil;

a first switch connected between said power supply and said ignition coil for switching on and off the conduction between said power supply and said the primary winding of said ignition coil based on the ignition signal shaped by said waveform shaper;

an integrator for integrating the ignition signal from said signal generator to provide a rpm voltage representative of the number of revolutions per minute of the engine;

a signal level controller for controlling the voltage level of the ignition signal based on the rpm voltage generated by said integrator;

a resistor interposed between said signal generator and said waveform shaper;

a current absorber for absorbing from the ignition signal a current in accordance with the voltage of said power supply;

a second switch operable to turn off said current absorber when the shaped signal generated by said waveform shaper rises; and a current-absorption suppressor for suppressing a current to be absorbed by said current absorber in accordance with the rpm voltage generated by said integrator.

2. An ignition apparatus according to claim 1, wherein said signal generator comprises an electromagnetic pickup coil which has one end thereof connected to ground and the other end thereof connected to said waveform shaper through a resistor.

3. An ignition according to claim 2, further comprising a buffer connected between said signal generator and said current absorber for eliminating a change in the level of the ignition signal due to variations in the internal impedance of said electromagnetic pickup coil.

4. An ignition apparatus according to claim 3, wherein said buffer comprises a buffer transistor which has an emitter connected to said waveform shaper, a base connected to said signal generator, and a collector connected to ground.

5. An ignition apparatus according to claim 4, wherein said buffer further comprises a constant current supply interposed between the emitter of said transistor and said power supply for supplying a constant current to the emitter of said buffer transistor irrespective of variations in the voltage of said power supply.

6. An ignition apparatus according to claim 1, wherein said waveform shaper comprises a comparator which has a first input terminal connected to said signal generator and said current absorber, and a second input terminal connected to said signal level controller, said comparator making a comparison between the ignition signal from said signal generator and the output signal of said signal level controller and generating an output signal to said first switch when the voltage level of the ignition signal is greater than that of the output signal of said signal level controller.

7. An ignition apparatus according to claim 6, wherein said signal level controller comprises:

an on-level setting circuit for setting an on-level voltage for said comparator; and an off-level setting circuit for setting an off-level voltage for said comparator, said off-level setting circuit being operable to reduce the output of said on-level setting circuit by a prescribed extent when said comparator generates an output.

8. An ignition apparatus according to claim 7, wherein said on-level setting circuit comprises a voltage divider connected between said power supply and the second input terminal of said comparator.

9. An ignition apparatus according to claim 8, further comprising a constant current supply interposed between said voltage divider and said power supply for supplying a constant current to said voltage divider.

10. An ignition apparatus according to claim 8, wherein said off-level setting circuit comprises:

a transistor having a collector connected to said current absorber, a base connected through a resistor to the output terminal of said comparator, and an emitter connected to ground.

* * * * *